United States Patent [19]

Hackett et al.

[11] Patent Number: 4,856,261

[45] Date of Patent: Aug. 15, 1989

[54] FORMING SMALL FLEXIBLE CONTAINERS

[75] Inventors: Malcolm J. Hackett, Lower Templestowe; Charalambos G. Kalkipsakis, Monbulk, both of Australia

[73] Assignee: Courtaulds Packaging Australia Limited, Hawthorn East, Australia

[21] Appl. No.: 118,541

[22] Filed: Nov. 9, 1987

[30] Foreign Application Priority Data

Nov. 27, 1986 [AU] Australia ..... PH09200
Mar. 3, 1987 [AU] Australia ..... PI0636

[51] Int. Cl.[4] ..... B65B 3/10; B65B 3/16; B65B 7/02

[52] U.S. Cl. ..... 53/469

[58] Field of Search ..... 53/434, 436, 468, 469

[56] References Cited

U.S. PATENT DOCUMENTS

| | | | |
|---|---|---|---|
| 2,870,583 | 1/1959 | Flax | 53/469 |
| 2,876,602 | 3/1959 | Ditlea | 53/469 |
| 2,958,169 | 11/1960 | Flax | 53/469 |
| 2,964,920 | 12/1960 | Staebler | 53/436 X |
| 3,206,908 | 9/1965 | Bodet | 53/469 |
| 3,813,845 | 6/1974 | Weikert | 53/469 |
| 4,422,548 | 12/1983 | Cheesman et al. | 206/370 |
| 4,557,377 | 12/1985 | Maloney | 206/219 |

FOREIGN PATENT DOCUMENTS

| | | | |
|---|---|---|---|
| 210986 | 8/1956 | Australia | 53/469 |
| 1538979 | 1/1979 | Australia . | |
| 2809184 | 11/1984 | Australia . | |
| 95878 | 11/1960 | Netherlands | 53/469 |

*Primary Examiner*—Robert L. Spruill
*Assistant Examiner*—Beth Bianca
*Attorney, Agent, or Firm*—Bell, Seltzer, Park & Gibson

[57] ABSTRACT

Small containers are filled and formed from a large preformed and presterilized container, which incorporates communicating compartments. The volume of contents of each compartment are equalized by pressure application and then the compartments are sealed off and severed to form individual containers.

2 Claims, 3 Drawing Sheets

FORMING SMALL FLEXIBLE CONTAINERS

FIELD OF THE INVENTION

This invention relates to a method of forming small flexible containers.

BACKGROUND OF THE INVENTION

Sachets of flexible film forming material are known. In the food packaging industry it has been conventional to "form, fill and seal". That is the individual flexible container is formed, it is then filled with food product and the container sealed. This means that one filling head can fill only one container at a time, For small containers production times are increased because the time taken to bring the container into alignment with the filling head and then to remove it, is significant and the volume of product filled from any filling head is correspondingly reduced when smaller containers are filled.

For consumer use and for applications where measured quantities of product are desirable in disposable containers there is a demand for small volume containers.

The cost to food packagers of using a form, fill and seal method as opposed to buying preformed packages and only filling and sealing is also significant. However preformed packages especially for small volumes are difficult to handle. Further where aseptic techniques are used sterilization becomes a problem. Thus in these applications the form, fill and seal method has been seen to be advantageous because a sterilization step can be carried out between the forming and filling sequences.

A number of proposals have been made to increase the volume of production of small containers using the form, fill, seal method. U.S. Pat. No. 4,517,787 is a recent example and U.K. No. 2054511 is an example of forming and filling a plurality of small compartments which are subsequently separated to form individual packages.

SUMMARY OF THE INVENTION

It is an object of this invention to provide a more effective means of increasing the volume of production on filling small containers and to provide an alternative means to the capital intensive form, fill and seal method.

To this end the present invention provides a method of forming filled flexible containers comprising:

- filling a large flexible container having heat sealable walls with a fluid product,
- applying to the container a template means to divide the container into separate communicating compartments by bringing opposed walls of the container into contact,
- distributing the content of the fluid product between said compartments by varying the pressure applied to the container to obtain a desired distribution, and
- heat sealing the opposed walls of the container together to form sealed filled compartments which are capable of separation into individual filled containers.

It is possible by this method to use a pre-sterilized container of the kind described in Australian patent No. 552,032. It can be filled and sealed and then stored or transported prior to being further handled to form the separate small packages. This method ensures that higher volume throughputs on the filling machine can be achieved. Aseptic packaging is also a feature of this method.

A further aspect of this invention is to provide a preformed flexible container with preformed intercommunicating compartments. The compartments may be formed by heat sealing portions of the walls of the larger container in a pattern which creates a series of intercommunicating compartments. For example in a rectangular envelope type container with an inlet at one end heat seals extending across the width of the container from the edge seams create a series of rectangular compartments. If a portion on line from the inlet is left unsealed a fill channel is formed. If this fill channel is down the centre of the envelope then it is possible to form two series of compartments.

Once the compartmented container is filled and sealed the final step of sealing the individual compartments can be performed at any desired time. To do this it is necessary to ensure a correct distribution of fluid content between the compartments. It is not necessary for these to be of the same size or for them to be filled to the same extent. The volume of product in each compartment is related to the pressure in each compartment and by varying the applied pressure it is possible to obtain any desired volume distribution between the compartments.

Fluid flow between the compartments is hindered by any creasing or kinking of the flexible package. By tensioning the package in the direction of the intercommunicating passages flow between compartments is facilitated. Thus during the step of distributing product between compartments the container envelope is preferably tensioned. This can be done by stretching or by supporting the envelope along the lines separating the compartments which are lateral to the intercommunicating passages. The weight of product then tensions the flexible container material to provide a crease free passage between compartments. This then facilitates the final heat sealing step whereby the passages are closed and separate sealed compartments are formed.

BRIEF DESCRIPTION OF THE DRAWINGS

In FIG. 1 a simple 4 compartment package is illustrated. This comprises an envelope 5 having a filling gland 6, an edge seal 7 and lateral heat seal seams 8. The passage 9 allows product entering through gland 6 to enter all compartments formed by the seams 8. The envelope 5 and the gland 6 are as described in Australian patent No. 552,032.

FIG. 2 is a variation of the package shown in FIG. 1. The envelope 11 has the filling gland 12 and edge seams 13 as previously described. The lateral seams 14 form two series of compartments on either side of a central passage 15. Two of the compartments are shown as having preformed seams 17 which are shaped to assist in product equilibration as described below. These seams are also shaped to enable easier dispensing of contents through the outlet 18 which in the separated container can be slit to allow pouring.

DESCRIPTION OF THE PREFERRED EMBODIMENTS

Figure 1:
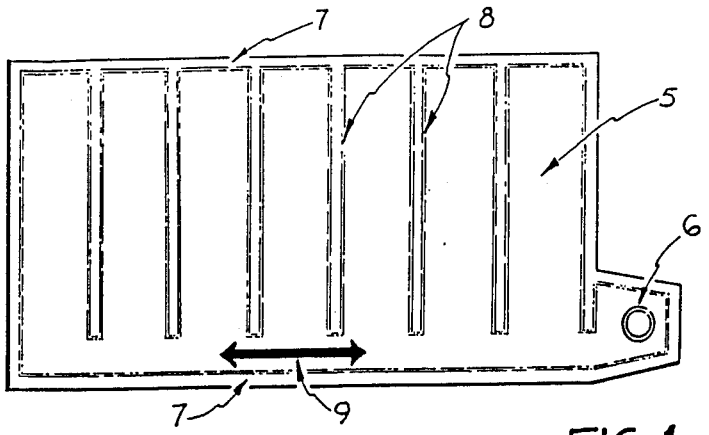
FIGS. 1 and 2 of the drawings illustrate two embodiments of this invention and FIG. 3 is a schematic representation of the apparatus used to distribute product between compartments and to heat seal them.
Figure 3:
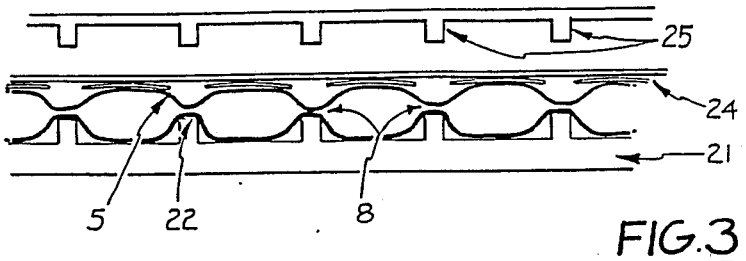

In FIG. 3 the package of FIG. 1 is schematically illustrated in the apparatus which achieves final product distribution between the compartments. The container 5 is supported by a corrugated base 21 along each lateral seam 8 by individual ribs 22. This opens up the channel 9 in the package 5 and allows free product flow. It also ensures that the walls of the envelope will have flat contact to facilitate good heat sealing. To obtain equal distribution of contents to each compartment the plate 24 applies pressure to the envelope 5. If desired individual pressure plates can be provided for each compartment and pressure measured to achieve a volume distribution calibrated on the measured pressure. Once the desired distribution is achieved the heat sealing rods 25 are lowered to heat seal the walls of the envelope together to extend seams 8 so that they extends from one edge seam 7 to the other and so form 4 separate compartments.

There is no limit on the number of compartments which may be formed. After heat sealing the compartments are separated by cutting along the centre of each seam 8 or 14. Alternatively the partition seals 8 or 14 may be partially or fully present or perforated to accommodate the decrease in horizontal length of the middle section when the multi pouch container 5 is filled. Where seals 8 and 14 are perforated these will split once the container is in the volume equalizing device of FIG. 3. A further heat seal is usually effected to enable the gland 6 to be discarded.

Figure 2:
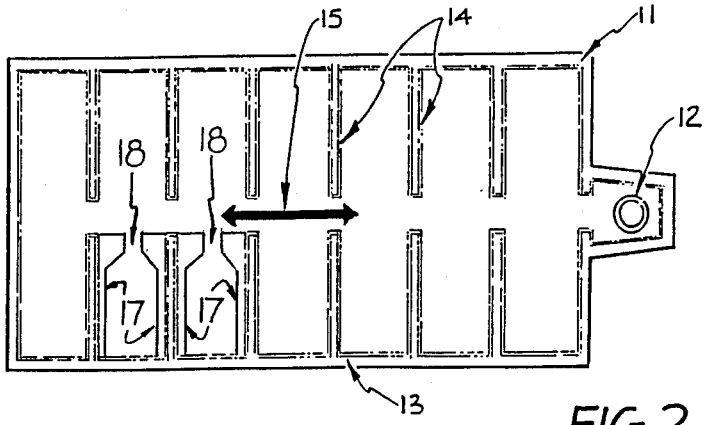

If the edge seals 7 of FIG. 1 and 13 of FIG. 2 are gussetted when the individual containers are sealed and separated this gussetted edge will form a base enabling the containers to stand upright.

The size of the compartment forming machine need only be half the length of the container envelope as the corrugated base increases tension on the envelope to allow easy flow along passage 9 and in so doing decreases the effective length of the envelope.

The embodiment shown in FIGS. 4 to 7 represents schematically the forming of the package shown in FIG. 2.

Figure 4:
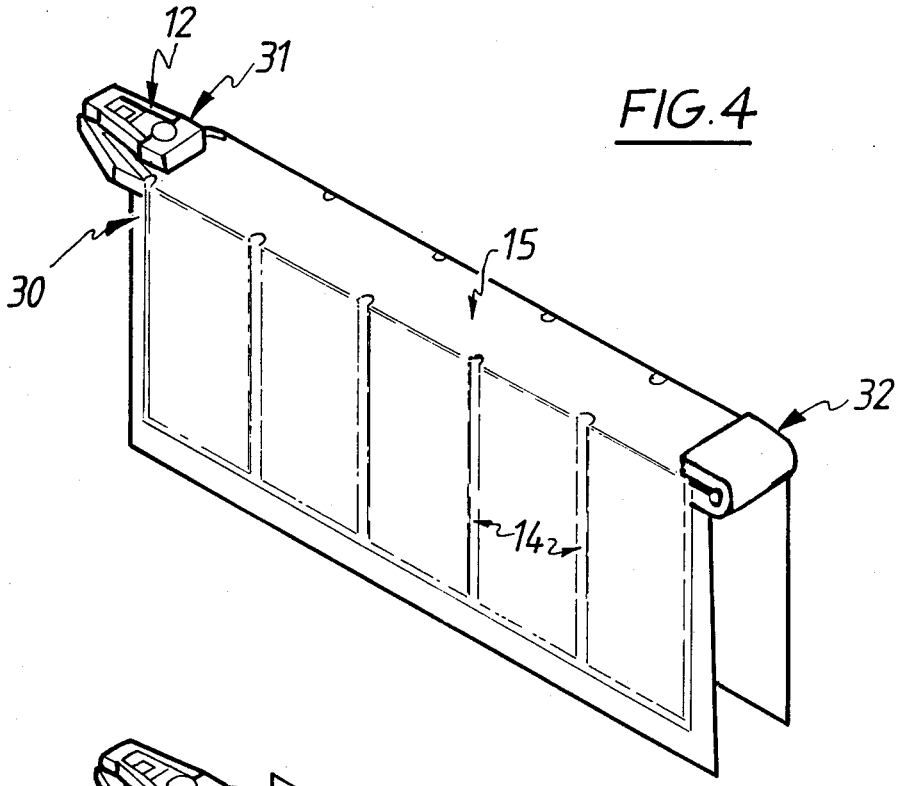
FIGS. 4, 5, 6 and 7 illustrate an alternative method of filling and forming utilizing the package construction shown in FIG. 2.

The filled bag 11 is draped over a central rail or saddle 30 and the filling gland 12 is secured by clamp 31 and the end of the bag 11 is secured at seam 13 by clamp 32 as shown in FIG. 4.

Figure 5:
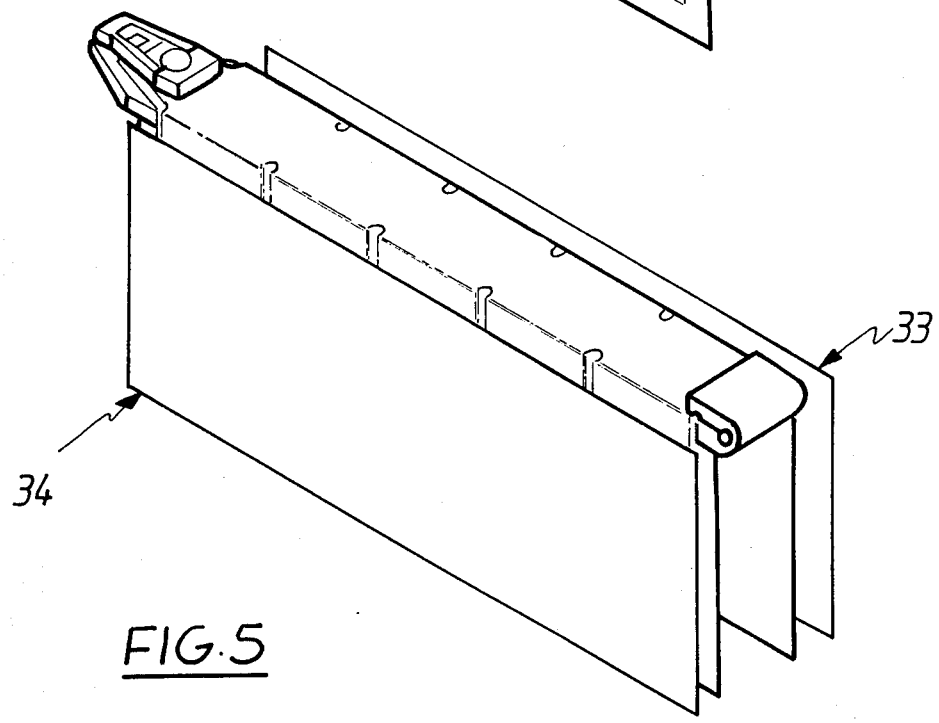

Subsequently as shown in FIG. 5 side pressure is applied by the pressure plates 33 and 34 to equalize the fluid level across all the compartments between the seams 14. Once equilibrium has been achieved the side pressure from plates 33 and 34 is released.

Figure 6:
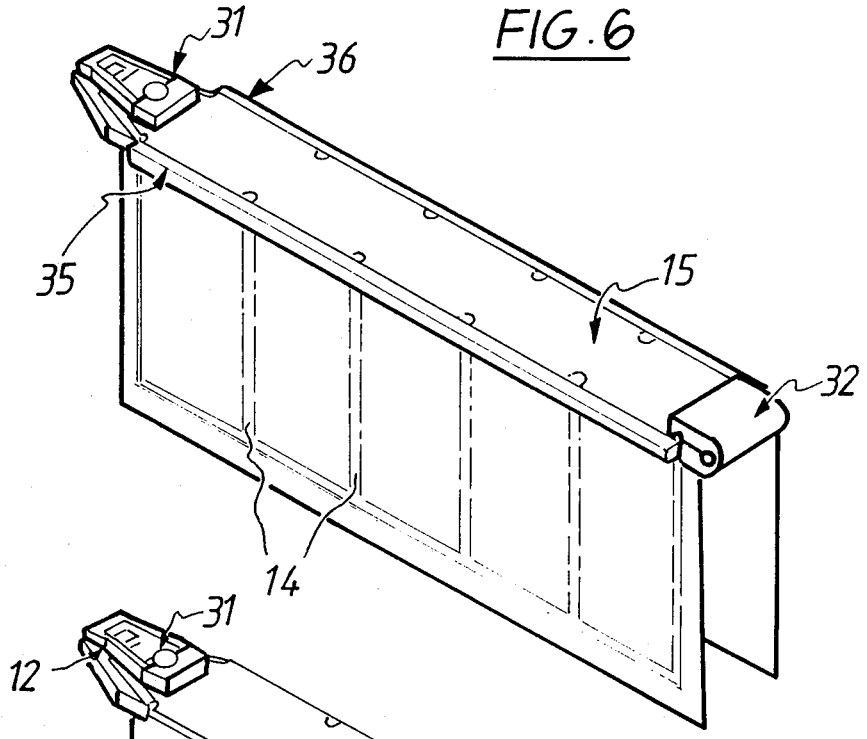

Next, as shown in FIG. 6 tension is applied between clamps 31 and 32 to remove creases which may have formed across passage 15. Heat sealing bars 35 and 36 are then applied against the sides of the bag to seal the top of each compartment along the lines bordering passage 15 and intersecting the ends of the seams 14.

The compartments may each then be separated by severing along the centre of the seams 14 and the newly formed topseals bordering passage 15.

Figure 7:
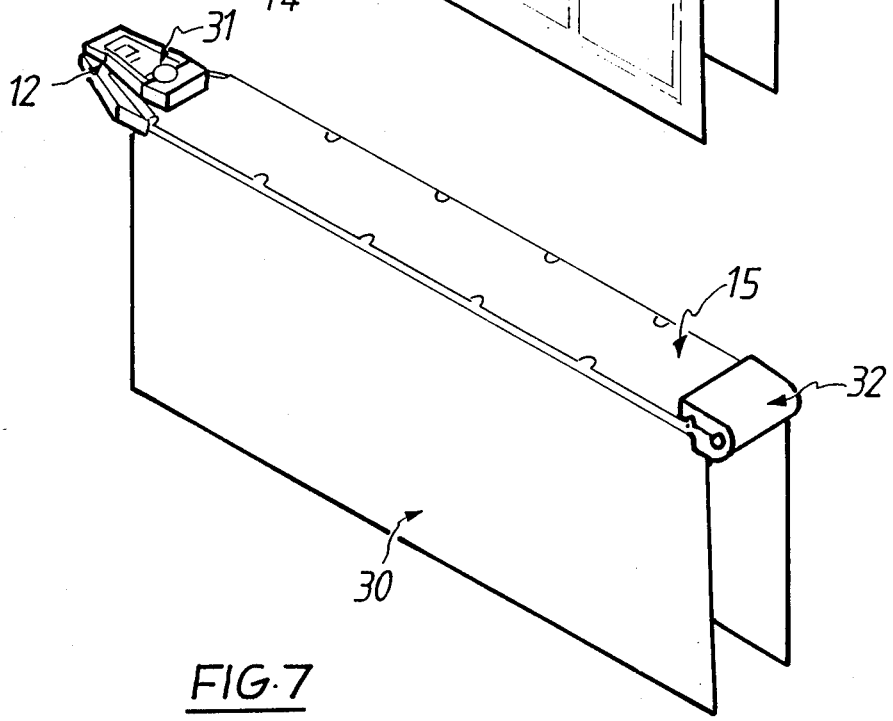

As shown in FIG. 7 after the severing operation only passage 15 and the filling gland 12 remain and these can be released from clamps 31 and 32 and discarded.

There is no restriction on the shape of size of the container or of the number, shape or size of compartments. The filling gland may be located at any convenient position either centrally of the container or at its periphery. An alternative to a rectangular container is a circular container with a central gland and radial seams to form compartments.

Thus it can be seen that the present invention provides a unique means of forming small fluid flexible packages whilst maintaining high production rates at the filling machine, eliminating the need to have expensive form, fill and seal machinery and also utilize aseptic filling techniques.

The claims defining the invention are as follows.

We claim:

1. A method of forming filled flexible containers comprising:

filling a large flexible container having heat sealable walls with a fluid product inserted into the container through a container inlet, supporting the container along its length intermediate its side edges so that opposite side portions of the container depend downwardly on either side of the support, applying to the depending side portions of the container a template means to divide the depending side portions of the container into separate communicating compartments by bringing opposed walls of the container into contact, distributing the content of the fluid product between said compartments in each depending side portion by varying the pressure applied to the depending side portions of the container to obtain a desired distribution, and heat sealing the opposed walls of the depending side portions of the container together to form sealed filled compartments which are capable of separation into individual filled containers.

2. A method as claimed in claim 1 wherein the container inlet is located at one end of the supported length of the large flexible container, and including the step of tensioning the supported length of the container in the direction of its length.

* * * * *

UNITED STATES PATENT AND TRADEMARK OFFICE

CERTIFICATE OF CORRECTION

PATENT NO. : 4,856,261

DATED : August 15, 1989

INVENTOR(S) : Malcolm J. Hackett & Charalabmos G. Kalkipsakis

It is certified that error appears in the above-identified patent and that said Letters Patent is hereby corrected as shown below:

Column 4, line 19, "fluid" should be -- filled --.

Signed and Sealed this

Twelfth Day of June, 1990

*Attest:*

HARRY F. MANBECK, JR.

*Attesting Officer*

*Commissioner of Patents and Trademarks*